US007681541B2

(12) United States Patent
Boggess et al.

(10) Patent No.: US 7,681,541 B2
(45) **Date of Patent: *Mar. 23, 2010**

(54) CAMSHAFT POSITION SENSING FOR DUAL OVERHEAD CAM VARIABLE VALVE TIMING ENGINES

(75) Inventors: Michael S. Boggess, Harrison Township, MI (US); Mark R. Arcori, Rochester Hills, MI (US); David W. Fiddes, Lake Orion, MI (US)

(73) Assignee: Chrysler Group LLC, Auburn Hills, MI (US)

( * ) Notice: Subject to any disclaimer, the term of this patent is extended or adjusted under 35 U.S.C. 154(b) by 59 days.

This patent is subject to a terminal disclaimer.

(21) Appl. No.: 11/374,907

(22) Filed: Mar. 14, 2006

(65) Prior Publication Data

US 2007/0215079 A1 Sep. 20, 2007

(51) Int. Cl.
*F01L 1/34* (2006.01)

(52) U.S. Cl. ..... 123/90.17; 123/90.31; 701/105

(58) Field of Classification Search ..... 123/90.15, 123/90.16, 90.17, 90.18, 90.27, 90.31, 90.6; 701/105, 110; 29/888.1
See application file for complete search history.

(56) References Cited

U.S. PATENT DOCUMENTS 6,343,580 B2 * 2/2002 Uchida ..... 123/90.17
6,474,278 B1 11/2002 Davis et al.
6,481,270 B1 * 11/2002 Kobayashi et al. ..... 73/114.26
6,708,126 B2 * 3/2004 Culler et al. ..... 702/64
6,729,280 B2 5/2004 Muraki
6,863,037 B2 3/2005 Iizuka et al.

FOREIGN PATENT DOCUMENTS

JP 2003293709 A * 10/2003

* cited by examiner

*Primary Examiner*—Ching Chang
(74) *Attorney, Agent, or Firm*—Ralph E. Smith

(57) ABSTRACT

A position sensing system uses two sensing elements to sense the rotary position of target wheels mounted on two camshafts. The two sensing elements are mounted in a common sensor housing and preferably the two sensor elements share power and ground wires, and each sensor element has its own signal wire. The wires preferably are contained within a common conduit that extends from the housing to a location outside of the rocker cover. The end of the conduit may support one-half of an electrical connector that terminates the wires from the sensors. Mounting the two sensing elements in a common housing simplifies mounting the sensors on the engine, and reduces the number of wires required to power and derive signals from the two sensors. The target wheels are mounted directly on the camshafts and are positioned along the axis of the camshaft, spaced from the camshaft ends.

19 Claims, 3 Drawing Sheets

CAMSHAFT POSITION SENSING FOR DUAL OVERHEAD CAM VARIABLE VALVE TIMING ENGINES

FIELD OF THE INVENTION

The present invention relates generally to position sensing and more particularly to sensing the rotary position of camshafts in overhead cam applications utilizing dual independent cam phasing.

BACKGROUND OF THE INVENTION

Existing camshaft sensing systems for dual overhead camshaft engines have a separate sensor assembly for each camshaft. Each sensor assembly must be precisely positioned and secured in place on the engine to accurately detect the rotary position of a camshaft. Current sensor systems use a target wheel mounted on the front or rear of the camshaft, increasing the overall head length. A hole is often formed in the head of the engine for each sensor and each sensor is mounted in its respective hole. Each hole has to be sealed to prevent leakage from the interior of the head to atmosphere.

Hall Effect transducers are commonly used as the camshaft position-sensing element in the sensor assembly. A Hall Effect transducer requires three leads to function properly; a power lead, a ground lead and a signal lead. A separable two-part connector is usually provided for the wiring from the transducer and comprises a male half and a female half with pin and socket contacts in the two-connector halves, respectively, which mate together to complete the sensor circuit. Accordingly, an in-line dual overhead cam engine has used two sensor elements each with its own housing, six leads coupling the two sensor elements to one connector half, six leads coupling the other connector half to the wiring for the vehicle, and six pins and six sockets within the two connector halves. In a V-configuration dual overhead cam engine, four sensor elements, twelve leads, and twelve pins and twelve sockets are required.

SUMMARY OF THE INVENTION

A sensing system includes two sensor elements mounted adjacent to the intake and exhaust camshafts of a dual overhead cam engine, preferably in a common housing. The system preferably requires only one mounting on the engine structure. In one implementation, the two sensor elements in the sensor assembly are opposite facing and positioned to sense the rotary position of a respective one of the two camshafts. The two sensor elements are coupled to a common power and ground lead. Each sensor element has its own signal lead.

Since the wiring from the two sensors emanates from a common sensor assembly, the wiring from the two sensors is conducted to a location outside of the rocker cover through a common conduit. In an in-line dual overhead camshaft engine, a common sensor assembly having two sensor elements eliminates the need for one sensor assembly, two leads, two pins and two sockets that would be required by two separate sensors. The common sensor assembly presents only one assembly to position and mount on the engine, reducing engineering hours per vehicle. Since the intake and exhaust camshafts are precisely mounted on the engine and the gap between them is tightly controlled, it is possible to position the dual element sensor between the two camshafts and to control the gap between the sensor elements and the target wheel with a high degree of precision. The precision mounting of the sensor assembly yields higher accuracy sensing of the target wheels and allows the use of smaller target wheels.

BRIEF DESCRIPTION OF THE DRAWINGS

These and other objects, features and advantages of the present invention will be apparent from the following detailed description of the preferred embodiments and best mode, appended claims and accompanying drawings in which:

DETAILED DESCRIPTION OF PREFERRED EMBODIMENTS

Figure 1:
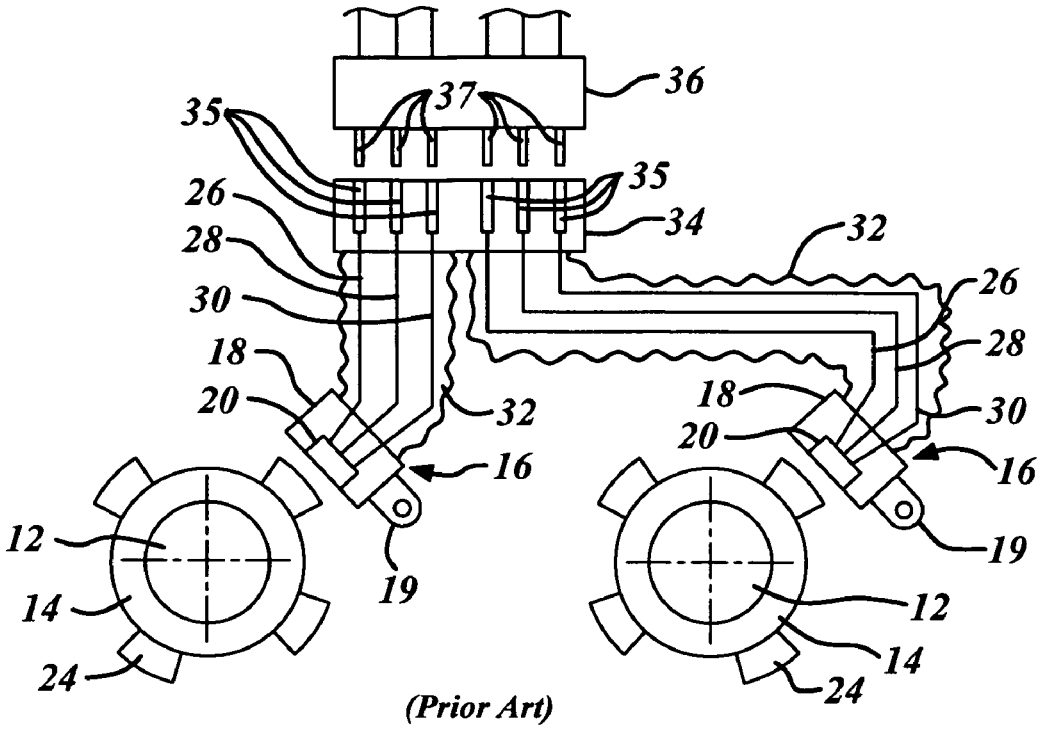
(Prior Art) FIG. 1
FIG. 1 is a graphical representation of the wiring required for the camshaft sensors used in a dual overhead engine according to the prior art.

FIG. 1 is a graphical representation according to the prior art of the wiring required for the camshaft sensors used in an in-line dual overhead cam engine. Each of the two camshafts 12 is provided with a target wheel 14 which turns in unison with the camshaft. A separate sensor assembly 16 is positioned adjacent each target wheel 14 to sense the rotational position thereof. Each sensor assembly 16 includes a housing 18 with a mounting structure 19 for securing the housing in place on the engine. Each housing supports a sensor element such as a Hall Effect transducer 20 in a position to sense the passage of a signal-producing feature such as a notch or a tooth 24 in the target wheel 14 as the target wheel is rotated by the camshaft 12.

Each Hall Effect sensor 20 is coupled to a power lead 26, a ground lead 28, and a signal lead 30. The three leads from each sensor assembly are protected by a wiring shroud 32 and are connected to a first half 34 of a connector block. The first half 34 of the connector block supports six contacts, shown for illustration purposes to be sockets 35. The second half 36 of the connector block supports six pins 37 which are positioned to mate with the six sockets 35 mounted on the first half 34 of the connector block. Thus, there are two sensor housings 18, two mounting structures 19 for the housings, six leads 26, 28, 30, two wiring shrouds 32, six pins 35 and six sockets 37 to provide an in-line dual overhead camshaft engine with two camshaft position sensor elements 22 coupled to the electrical circuitry of the engine. In a V-configuration dual overhead camshaft engine, since there are four camshafts, twice as many elements would be required.

Figure 2:
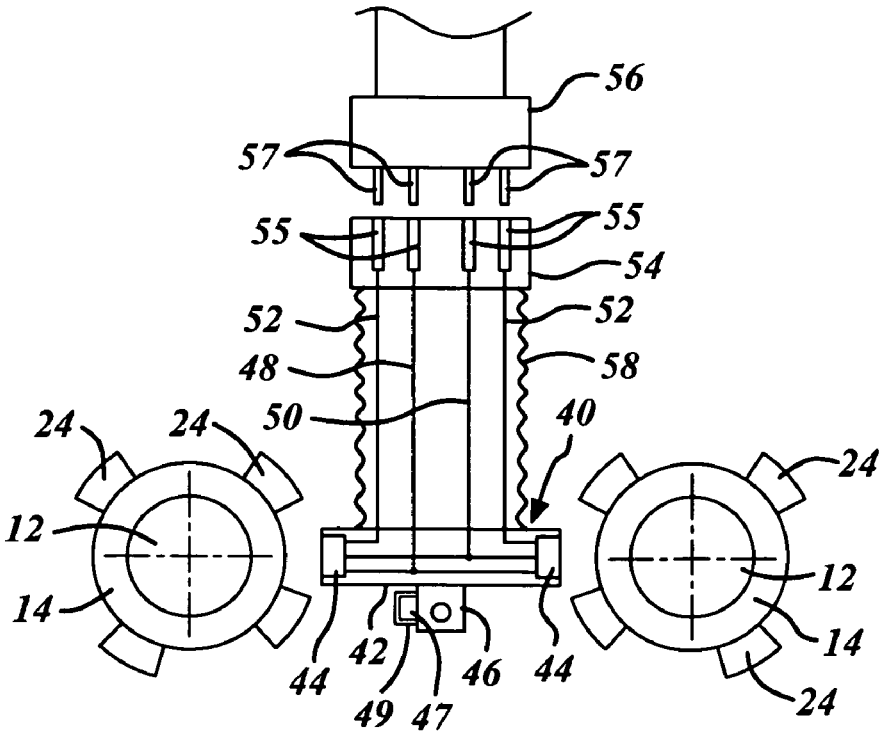
FIG. 2 is a graphical representation of the wiring required for one presently preferred embodiment of a sensing system that may be used in a dual overhead cam engine.

FIG. 2 is a graphical representation of one presently preferred embodiment of a sensor assembly generally showing the wiring required for the sensors used in an in-line dual overhead cam engine. Each camshaft 12 is provided with a target wheel 14 which turns in unison with the camshaft. A single sensor assembly 40 is positioned adjacent or between the two target wheels 14 to sense the rotational position thereof. The sensor assembly 40 includes a housing 42 that has two oppositely facing ends that each support a separate one of two oppositely facing sensors 44 that are each in a position to sense the passage of a signal-producing feature 24 on the adjacent target wheel 14 as the two target wheels are rotated by the camshafts 12. The sensors may be Hall Effect sensors or any other suitable sensor-type, as desired. The single housing 42 preferably is mounted to the engine with a single mounting structure 46. The mounting structure 46 may include one or more mounting tabs 47 that engage a matching number of detents 49 on the engine to ensure that the sensor assembly 40 is attached to the engine in the correct angular orientation relative to the target wheels 14. The two Hall Effect sensors 44 are coupled to a common power lead 48 and a common ground lead 50. Each sensor 44 is coupled to its own signal lead 52. Thus, the two sensors 44 require only the common power and ground leads 48, 50, and the two signal leads 52; the four leads from the two sensors 44 are connected to the first half 54 of a connector block.

A single shroud or conduit 58 is provided between the sensor assembly 40 and the first half 54 of the connector block. The first half of the connector block 54 supports four contacts, shown for illustration purposes to be sockets 55. The second half 56 of the connector block supports four pins 57 which are positioned to mate with the four sockets 55 in the first half of the connector block 54. Thus, according to the invention, only one housing 42, one mounting structure 46, four leads 48, 50, 52, one wiring shroud 58, four pins 57 and four sockets 55 are required to provide an in-line, dual, overhead camshaft engine with two camshaft position sensor elements 44 coupled to the electrical circuitry of the engine.

Figure 3:
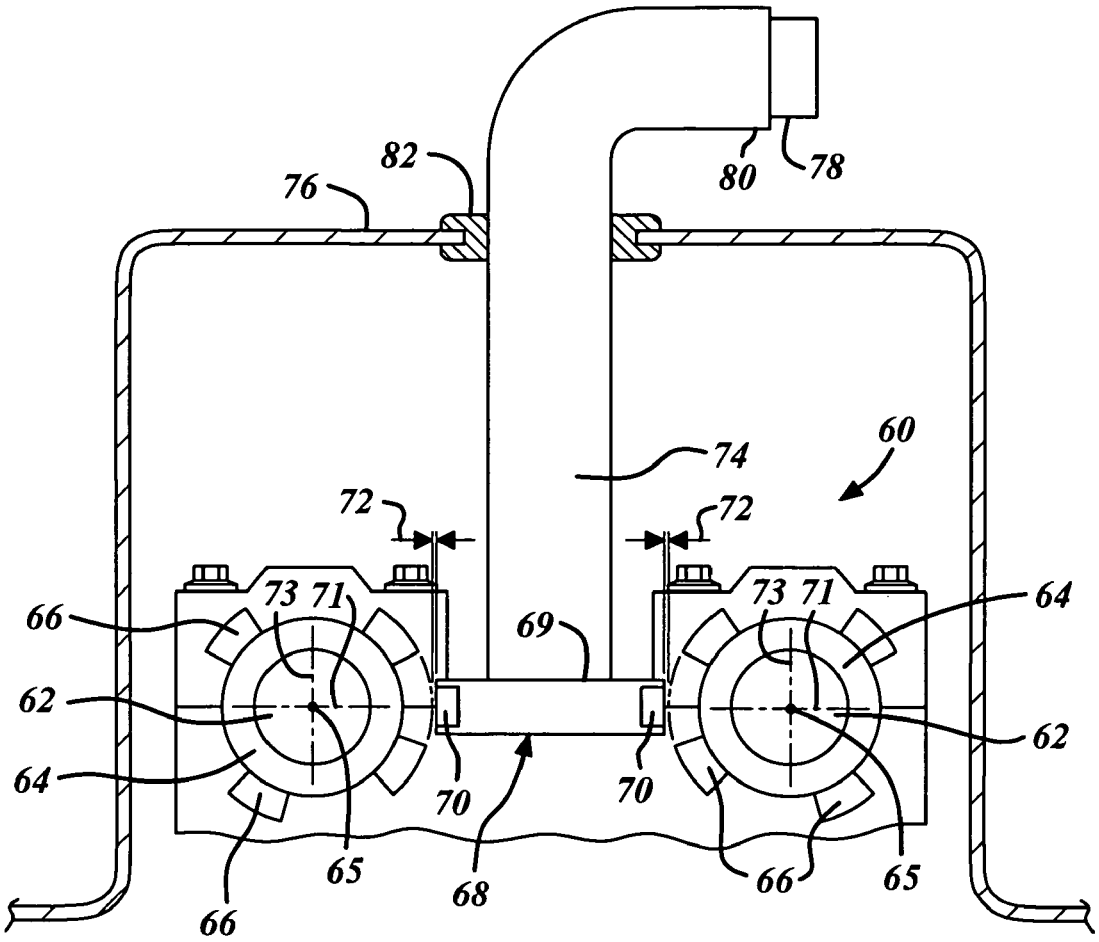
FIG. 3 is an end view of the head assembly of an engine, partly in section, showing a dual element sensor positioned between two target wheels.

FIG. 3 shows a portion of the head assembly 60 of a dual overhead cam engine including the ends 62 of two camshafts. A target wheel 64 is mounted along the axis of each camshaft to turn in unison wherewith. Each target wheel 64 has one or more signal producing features such as a notch or a tooth 66 for producing a pulse in a sensing device as is well known in the art. Each target wheel 64 may be made of ferromagnetic material or molded magnetic material that can be polarized in any pattern. A sensor assembly 68 is mounted between the two target wheels 64. The sensor assembly 68 includes a common housing 69 and two sensing elements 70, one facing one target wheel 64 and one facing the other target wheel 64. In the embodiment shown, the sensing elements 70 face in opposite directions and are disposed generally directly between the camshafts on the centerline of the camshafts, or along a plane containing the axis 65 of rotation of each camshaft. Other arrangements and positions can be utilized. Thus, the common housing 69 positions each sensing element 70 in a reading position with respect to its corresponding one of the target wheels 64 so that both target wheels can be read by the sensing elements. Because the position of each of the camshafts 62 is precisely known, mounting the sensor assembly 68 between the two camshafts takes advantage of the tight tolerances on the camshaft center lines 71, 73 to control the air gap 72 between the target wheels 64 and the ends of the opposite facing sensing elements 70.

A molded plastic wiring shroud or conduit 74 is attached to the sensor assembly 68, and extends through the top of rocker cover 76. The leads from the sensors in the sensor assembly pass through the conduit to an electrical coupling 78 that may be mounted on the end 80 of the conduit and outside of the rocker cover 76. A sealing element 82 such as a rubber grommet provides a seal between the conduit 74 and the rocker cover 76 to inhibit or prevent the escape of gasses from the interior of the rocker cover.

Figure 4:
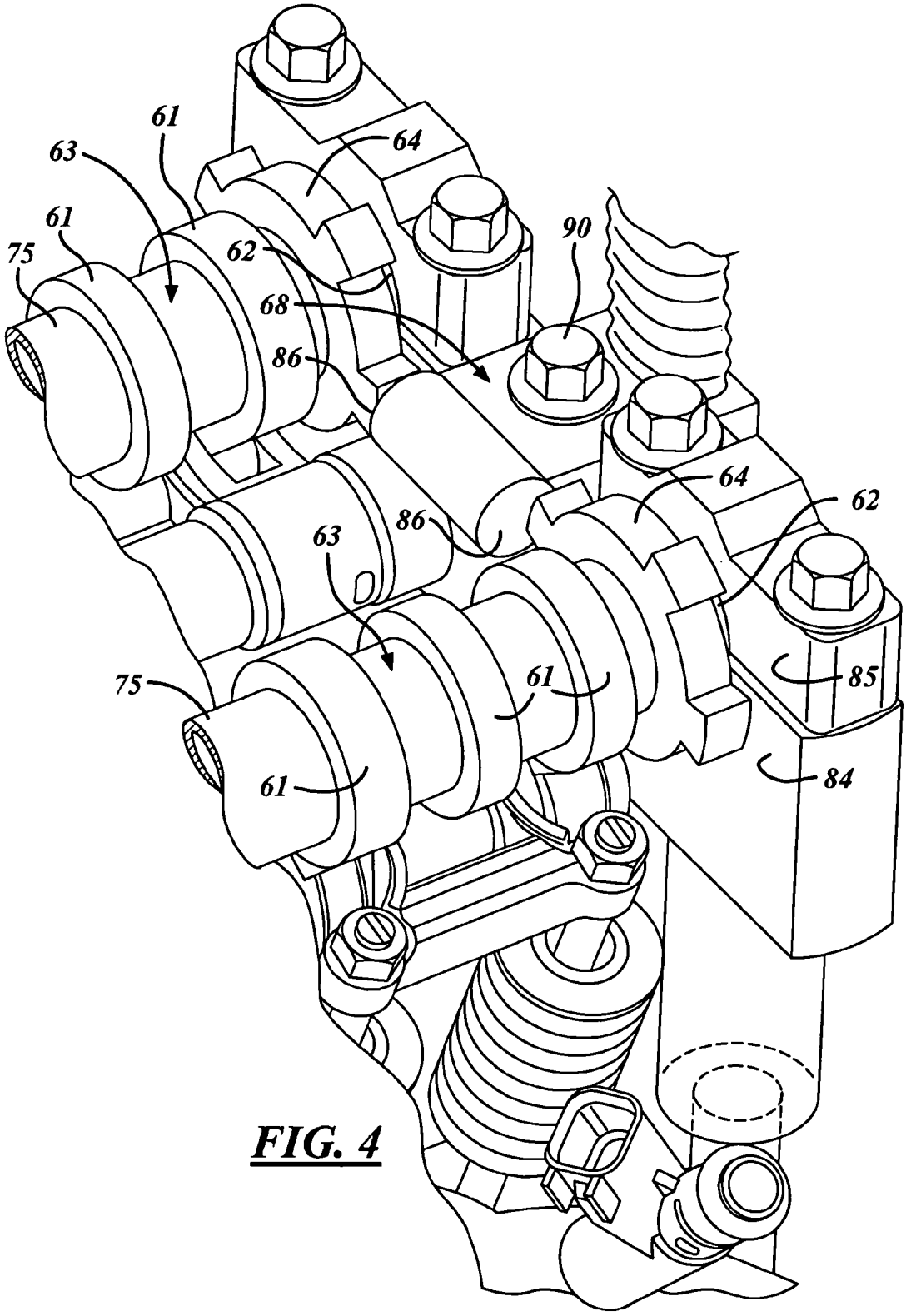
FIG. 4 is a top perspective view of a dual element sensor mounted between the target wheels of two camshafts.

FIG. 4 shows the mounting of the sensor assembly 68 on a pillow block 84 at the end of the head assembly. This mounting of the sensor assembly 68 on the pillow block 84 provides perpendicularity between the sensors in the ends 86 of the sensor assembly and the target wheels 64. A single fastener 90 may be used to secure the sensor assembly 68 to the pillow block 84.

The mounting of the end 62 of each of the camshafts 63 is provided by a bearing assembly that is held between the pillow block 84 and a cam cap 85 as well known in the art. Positioning each of the target wheels 64 on a respective camshaft 63 spaced from the end 62 of the camshaft and inboard of the pillow block 84 eliminates the problem of increasing the length of the head that occurs if the target wheel is mounted on the front or rear end of the camshaft. The camshaft 63 may be an assembled camshaft that is manufactured by placing cam rings 61 and the target wheel 64 along the axis of a hollow tube 75 that is then expanded to lock the cam rings and the target wheel in place. Using an assembled camshaft provides the unique ability to position the target wheels at any location along the axis of the camshaft. Of course, other methods may be used to position and lock the target wheels onto the camshaft.

Having thus described a presently preferred implementation of the position sensing assembly, various modifications and alterations will occur to those skilled in the art, which modifications and alterations will be within the scope of the invention as defined by the appended claims.

What is claimed is:

1. A sensing system for sensing the rotary position of two camshafts, the sensing system comprising:

a target wheel mounted along the axis of each camshaft for tuning in unison with the camshaft;

two sensing elements adapted to read the position of the two camshafts, one sensing element faces one target wheel and the other sensing element faces the other target wheel; and a common housing for the two sensing elements positioned between the two camshafts for positioning the two sensing elements facing opposite one another with the common housing having oppositely facing ends with one of the two sensing elements mounted to one of the oppositely facing ends and the other one of the two sensing elements mounted to the other one of the oppositely facing ends.

2. The sensing system of claim 1 further comprising:

a common power lead for the two sensing elements;

a common ground lead for the two sensing elements; and a separate signal lead for each sensing element, whereby the total number of leads required for the two sensing elements is four.

3. The sensing system of claim 1 further comprising:

a rocker cover covering the two camshafts and the common housing; and a hollow conduit extending from the common housing to the exterior of the rocker cover, the hollow conduit passing through an opening in the rocker cover.

4. The sensing system of claim 3 further comprising:

leads for conducting signals produced by the two sensing elements to a location outside of the rocker cover, the leads passing through the hollow conduit.

5. The sensing system of claim 3 further comprising:

one half of an electrical connector mounted in the end of the hollow conduit positioned outside of the rocker cover, the electrical connector requiring only four contacts to terminate each of the leads from the two sensing elements.

6. A camshaft position sensing device for a dual overhead cam variable valve timing engine having a pair of camshafts mounted parallel to one another, the camshaft position sensing device comprising:

a target wheel on each camshaft and adapted to rotate in unison therewith;

two sensing elements, one for each target wheel, facing in opposite directions and disposed between the camshafts on the centerline of the camshafts; and a common housing for the two sensing elements, the common housing positioning each sensing element so chat it is in a reading position with respect to one of the target wheels, whereby both target wheels are read by the two sensing elements.

7. The camshaft position sensing device of claim 6 wherein the housing has two oppositely facing ends and the sensing elements are located one each in the two oppositely facing ends of the common housing.

8. The camshaft position sensing device of claim 6 wherein the common housing is located between the two camshafts.

9. The camshaft position sensing device of claim 6 wherein the common housing positions the two sensing elements on a centerline of the target wheels.

10. The camshaft position sensing device of claim 6 wherein a single fastening device is used to mount the common housing between the two camshafts.

11. The camshaft position sensing device of claim 6 further comprising:

a common power lead for the two sensing elements;

a common ground lead for the two sensing elements; and separate signal leads for the two sensing elements, whereby the two sensing elements require only four leads to read the position of the two camshafts.

12. The camshaft position sensing device of claim 6 further comprising:

a rocker cover over the two camshafts and the common housing; and a hollow conduit mounted to the common housing and extending outside of the rocker cover, the power, ground and signal leads for the sensing elements being contained within the hollow conduit.

13. The camshaft positioning device of claim 12 further comprising:

an electrical coupling located on the end of the hollow conduit that is positioned outside of the rocker cover, the leads from the two sensing elements being connected to the electrical coupling.

14. The camshaft position sensing device of claim 6 further comprising:

a pillow block in the engine for mounting the ends of the camshafts, the pillow block providing a mounting surface for the common housing.

15. The camshaft position sensing device of claim 14 wherein the target wheels are spaced from the ends of the camshaft and are located on the same side of the pillow block as the camshafts, whereby the target wheels do not increase the overall length of the engine.

16. The camshaft position sensing device of claim 6 further comprising a mounting tab on the common housing, wherein the mounting tab orients the common housing in the correct angular orientation relative to the two target wheels.

17. A camshaft position sensing device for a dual overhead cam variable valve timing engine having a pair of camshafts mounted parallel to one another, the camshaft position sensing device comprising:

a target wheel mounted on each camshaft and adapted to rotate in unison therewith;

two sensing elements, one for each target wheel;

a common housing positioned between the two camshafts for housing the two sensing elements, the common housing positioning each sensing element so that it is in a reading position with respect to one of the target wheels, whereby both target wheels are read by the two sensing elements;

two oppositely facing ends on the common housing, the sensing elements being located on each in the two oppositely facing ends of the common housing and along a plane containing the axis of rotation of each camshaft;

a common power lead for the two sensing elements;

a common ground lead for the two sensing elements; and separate signal leads for the two sensing elements, whereby the two sensing elements require only four leads to read the position of the two camshafts.

18. The camshaft position sensing device of claim 17, further comprising:

a rocker cover over the two camshafts and the common housing; and a hollow conduit mounted to the common housing and extending outside of the rocker cover, the power, ground and signal leads for the sensing elements being contained with the hollow conduit.

19. The camshaft position sensing device of claim 17, further comprising:

a pillow block in the engine for mounting the ends of the camshafts, the pillow block providing a mounting surface for the common housing;

the target wheels being spaced from the ends of the camshafts and located on the same side of the pillow block as the camshafts, whereby the target wheels do not increase the overall length of the engine.

* * * * *